US007836554B2

(12) United States Patent
Fu

(10) Patent No.: US 7,836,554 B2
(45) Date of Patent: Nov. 23, 2010

(54) DOUBLE HINGE ASSEMBLY AND ELECTRONIC DEVICE USING THE SAME

(75) Inventor: Chao-Zhong Fu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 395 days.

(21) Appl. No.: 12/124,167

(22) Filed: May 21, 2008

(65) Prior Publication Data

US 2009/0165251 A1 Jul. 2, 2009

(30) Foreign Application Priority Data

Dec. 27, 2007 (CN) ..... 200710203485

(51) Int. Cl.
*E05D 15/00* (2006.01)

(52) U.S. Cl. ..... 16/362; 16/364; 16/357; 16/361; 16/366; 455/575.4

(58) Field of Classification Search ..... 16/362, 16/363, 364, 357, 360, 361, 366, 367, 368, 16/369, 370, 371; 49/246, 247, 250, 251, 49/253, 260, 261; 312/323, 322, 139.1; 248/295.11, 298.1; 455/575.4
See application file for complete search history.

(56) References Cited

U.S. PATENT DOCUMENTS 1,535,668 A * 4/1925 Jostedt ..... 16/345
2,208,887 A * 7/1940 Westwood ..... 16/360
5,168,426 A * 12/1992 Hoving et al. ..... 361/679.09
5,494,447 A * 2/1996 Zaidan ..... 439/31
5,535,482 A * 7/1996 Grabber ..... 16/286
5,581,942 A * 12/1996 Sill et al. ..... 49/253
5,645,333 A * 7/1997 Sakurai ..... 312/322
7,065,835 B2 * 6/2006 Kuramochi ..... 16/357
7,356,954 B2 * 4/2008 Shimizu et al. ..... 40/491
7,360,278 B2 * 4/2008 Jang et al. ..... 16/357
7,539,526 B2 * 5/2009 Pirila et al. ..... 455/575.3
7,573,703 B2 * 8/2009 Chuang et al. ..... 361/679.27

(Continued)

FOREIGN PATENT DOCUMENTS

FR 2574108 A1 * 6/1986

(Continued)

*Primary Examiner*—Victor Batson
*Assistant Examiner*—Jeffrey O'Brien
(74) *Attorney, Agent, or Firm*—Frank R. Niranjan

(57) ABSTRACT

An exemplary double hinge assembly includes a first hinge assembly, a second hinge assembly, a guide rail, a sliding member, a first bracket, a second bracket. The sliding member is slidably positioned on the guide rail. The first hinge assembly includes a first rotatable pivot shaft. The second hinge assembly includes a second rotatable pivot shaft. The first bracket is fixed to the first rotatable pivot shaft, and the guide rail rotatably connects to the first rotatable pivot shaft. The second bracket is fixed to the second rotatable pivot shaft, and the sliding member rotatably connects to the second rotatable pivot shaft. A rotating axis of the first rotatable pivot shaft is substantially parallel to a rotating axis of the second rotatable pivot shaft. In addition, an electronic device using the double hinge assembly is also provided.

11 Claims, 10 Drawing Sheets

U.S. PATENT DOCUMENTS

| | | | | |
|---|---|---|---|---|
| 7,671,841 | B2 * | 3/2010 | Lee et al. | 345/158 |
| 2003/0109230 | A1 * | 6/2003 | Duarte et al. | 455/90 |
| 2005/0223524 | A1 * | 10/2005 | Muir | 16/366 |
| 2006/0148543 | A1 * | 7/2006 | Hunt | 455/575.4 |
| 2007/0050947 | A1 * | 3/2007 | Moore | 16/371 |
| 2007/0289100 | A1 * | 12/2007 | Lake et al. | 16/362 |

FOREIGN PATENT DOCUMENTS

| | | | |
|---|---|---|---|
| GB | 2132671 | A * | 7/1984 |

* cited by examiner

DOUBLE HINGE ASSEMBLY AND ELECTRONIC DEVICE USING THE SAME

BACKGROUND OF THE INVENTION

1. Field of the Invention

The present invention relates generally to hinge assemblies and electronic devices using the same, more particularly to a double hinge assembly and an electronic device using the same.

2. Discussion of the Related Art

An electronic device such as a mobile phone, a notebook computer, or a personal digital assistant (PDA) generally has a main body and a cover with a display and a camera lens pivotally mounted on the main body via a hinge. A typical hinge includes a first cam, a second cam, a spring, and an O-ring. A shaft extends from a center of the second cam, and the shaft defines a groove on an outer surface. The slide cam defines a central hole. The shaft extends through the first cam and the spring, and the O-ring engages in the groove of the shaft, thus the typical hinge is assembled.

By using the typical hinge, a cover of the electronic device can be turned around a horizontal axis in order to change a viewing angle. However, the cover cannot be turned 180 degrees for purposes of, for example, viewing a display located in the cover while taking a self portrait using the camera of the device, thus affecting the efficiency and image. In addition, the cover can only be turned in a direction relative to the main body, but more and more users want the cover be rotatable and slidable relative to the main body for convenient use, such as showing the display to a person in front of the user. That is, the electronic device with the typical hinge is quite inconvenient for use.

Therefore, a double hinge assembly and an electronic device using the same to solve the aforementioned problems is desired.

SUMMARY

In one aspect, a double hinge assembly includes a first hinge assembly, a second hinge assembly, a guide rail, a sliding member, a first bracket, a second bracket. The sliding member is slidably positioned on the guide rail. The first hinge assembly includes a first rotatable pivot shaft. The second hinge assembly includes a second rotatable pivot shaft. The first bracket is fixed to the first rotatable pivot shaft, and the guide rail rotatably connects to the first rotatable pivot shaft. The second bracket is fixed to the second rotatable pivot shaft, and the sliding member rotatably connects to the second rotatable pivot shaft. A rotating axis of the first rotatable pivot shaft is substantially parallel to a rotating axis of the second rotatable pivot shaft.

In another aspect, exemplary double hinge assembly includes a first hinge assembly, a second hinge assembly, a guide rail, a sliding member, a first bracket, a second bracket. The sliding member is slidably positioned on the guide rail. The first hinge assembly includes a first rotatable pivot shaft. The second hinge assembly includes a second rotatable pivot shaft. The first bracket is fixed to the first rotatable pivot shaft, and the second bracket is fixed to the second rotatable pivot shaft. The guide rail defines a first pivot hole. The sliding member defines a second pivot hole therein. The first rotatable pivot shaft extends through the first pivot hole of the guide rail. The second rotatable pivot shaft extends through the second pivot hole of the sliding member.

In still another aspect, an electronic device includes a main body, a cover, and a double hinge assembly. The double hinge assembly is one of the hinge assemblies as described in the previous two paragraphs. The cover has a display body. The double hinge assembly connects the main body and the cover such that the cover is rotatable around two horizontal axes relative to the main body.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present double hinge assembly and the electronic device using the same. Moreover, in the drawings, like reference numerals designate corresponding parts throughout the several views.

DETAILED DESCRIPTION OF THE EMBODIMENTS

The present double hinge assembly may be used in electronic devices such as mobile phones, notebook computers, and personal digital assistants. For the purposes of conveniently describing an exemplary application of the double hinge assembly, a preferred embodiment of the double hinge assembly as used in a mobile phone is described and illustrated.

Figure 1:
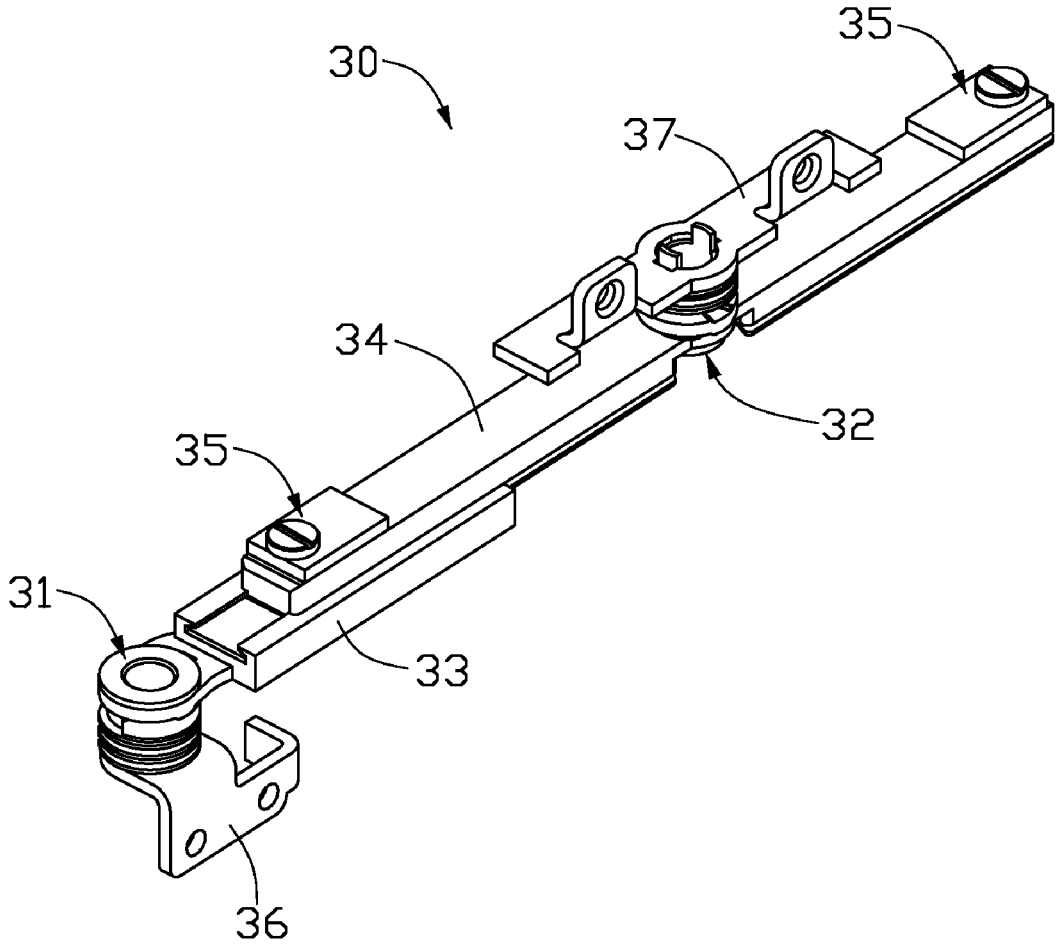
FIG. 1 is an assembled, isometric view of a double hinge assembly in accordance with a preferred embodiment of the present application.

Referring to the drawings in detail, FIG. 1 shows a double hinge assembly 30 of an exemplary embodiment of the present invention. The double hinge assembly 30 includes a first hinge assembly 31, a second hinge assembly 32, a guide rail 33, a sliding member 34, two positioning assemblies 35, a first bracket 36, and a second bracket 37.

Figure 2:
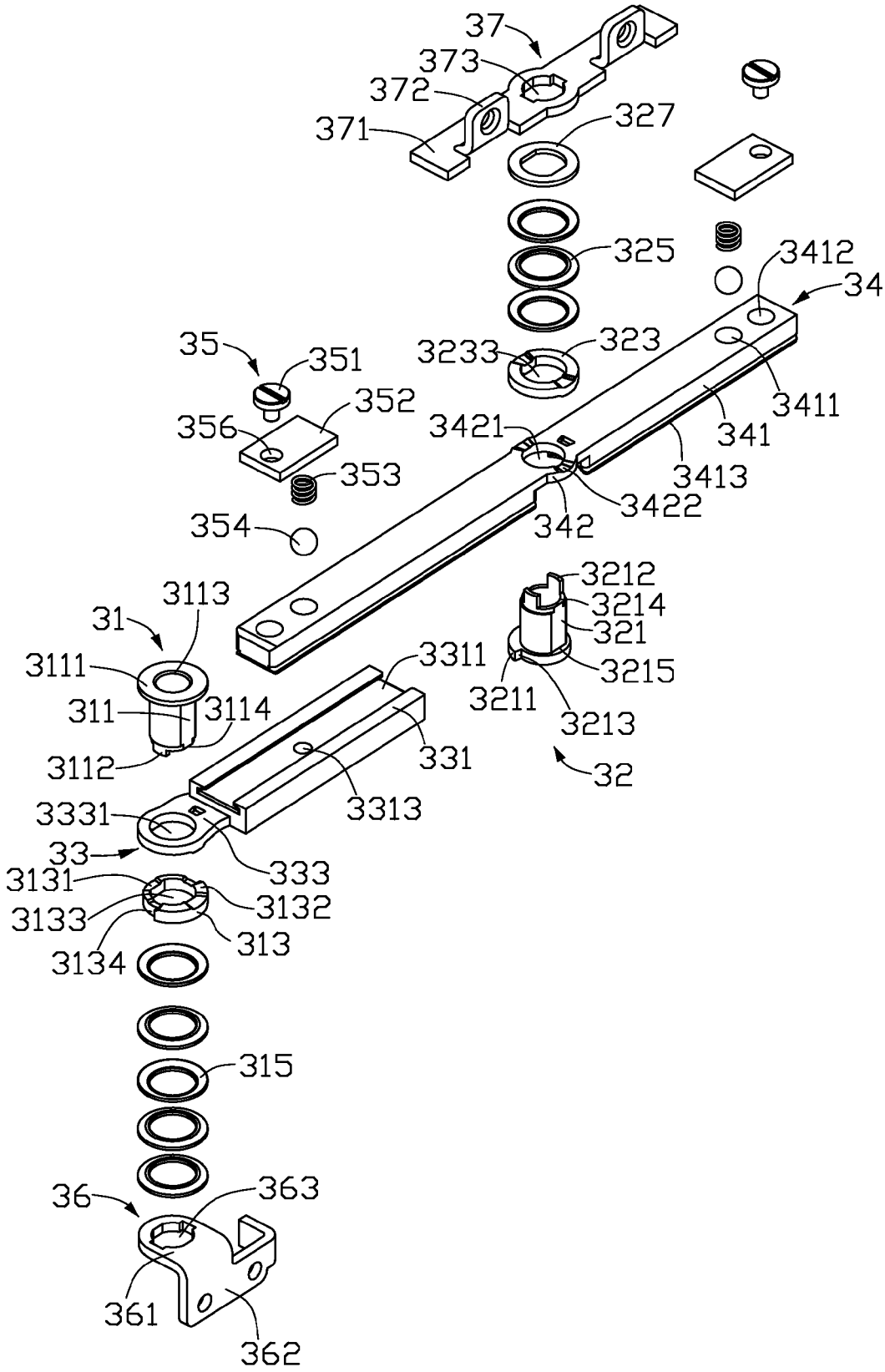
FIG. 2 is an exploded, isometric view of the double hinge assembly of FIG. 1.
Figure 3:
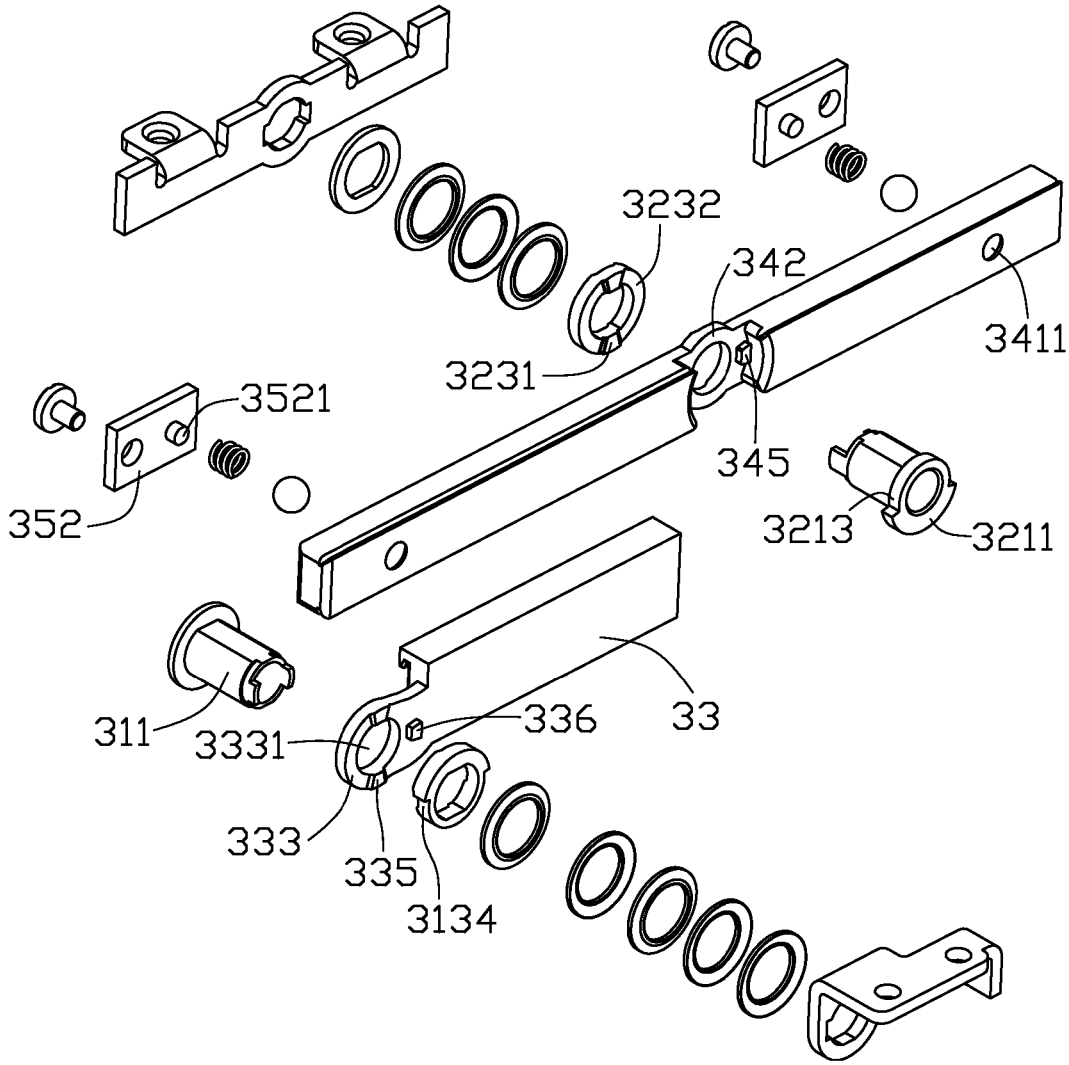
FIG. 3 is similar to FIG. 1, but viewed from another aspect.

Referring to FIGS. 2 and 3, the first hinge assembly 31 includes a first rotatable pivot shaft 311, a first cam 313, and a plurality of resilient rings 315. The first rotatable pivot shaft 311 is substantially a hollow shaft. A flange 3111 is formed around an end 3113 of the first rotatable pivot shaft 311, and two protrusions 3112 are formed at opposite sides of another end 3114 of the first rotatable pivot shaft 311. A cross-section of the first rotatable pivot shaft 311 perpendicular to an axis of the first rotatable pivot shaft 311 is double-D shaped. The first cam 313 is approximately a hollow cylinder, and a center of the first cam 313 defines a first cam pivot hole 3133. The first cam pivot hole 3133 is a non-circular hole corresponding to the cross-section of the first rotatable pivot shaft 311. The first cam 313 defines four depressions 3131 in a top engaging surface 3132. The first cam 313 also defines a limiting guide groove 3134 in the cylindrical surface. The resilient rings 315 and the first cam 313 are configured to sleeve on the first rotatable pivot shaft 311. The first cam 313 is configured to be non-rotatable relative to the first rotatable pivot shaft 311.

The second hinge assembly 32 includes a second rotatable pivot shaft 321, a second cam 323, a plurality of resilient rings 325, and a flat washer 327. The second rotatable pivot shaft 321 is substantially a hollow shaft. A cross-section of the second rotatable pivot shaft 321 perpendicular to an axis of the second rotatable pivot shaft 321 is double-D shaped. A flange 3211 is formed around an end 3215 of the second rotatable pivot shaft 321, and two protrusions 3212 are formed at the opposite sides of another end 3214 of the second rotatable pivot shaft 321 opposite to the end 3214. The flange 3211 defines a limiting guide groove 3213 in the cylindrical surface. The second cam 323 is approximately a ring. A center of the second cam 323 defines a second cam pivot hole 3233. The second cam pivot hole 3233 is a non-circular hole corresponding to the cross-section of the second rotatable pivot shaft 321. The second cam 323 includes two protrusions 3231 formed on opposite sides of a bottom engaging surface 3232. The second cam 323, the resilient rings 325, and the flat washer 327 are configured to sleeve on the second rotatable pivot shaft 321. The second cam 323 is configured to be non-rotatable relative to the second rotatable pivot shaft 321.

The guide rail 33 includes a guiding portion 331 and a pivot socket 333 formed at an end of the guiding portion 331. The guiding portion 331 defines a sliding groove 3311, and a blind hole 3313 in a center of the bottom surface of the sliding groove 3311. A center of the pivot socket 333 defines a circular pivot hole 3331. Two teeth 335 extend out of a bottom surface of the pivot socket 333 and configured for engaging with the engaging surface 3132 of the first cam 313. A top surface the pivot socket 333 also forms a limiting protrusion 336 adjacent to the pivot hole 3331, and is configured to be slidable along the limiting guide groove 3134 of the first cam 313.

The sliding member 34 includes a pivot socket 342 and two arms 341. The arms 341 extend from opposite sides of the pivot socket 342. A center of the pivot socket 342 defines a circular hole 3421. The pivot socket 342 defines two depressions 3422 in a top surface for engaging with the engaging surface 3232 of the second cam 323. The pivot socket 342 also forms a limiting projection 345 adjacent to the circular hole 3421 at a bottom surface thereon, and the limiting projection 345 can slide along the limiting guide groove 3213 of the flange 3211. Each arm 341 defines a receiving hole 3411 and a blind hole 3412 adjacent to the receiving hole 3411 at an end away from the pivot socket 342. A size of a bottom side of the receiving hole 3411 is gradually reduced. A flange 3413 is form around a surface opposite to the guide rail 33 of each arm 341. The flange 3413 is configured for receiving in the sliding groove 3311.

The positioning assemblies 35 are positioned in opposite ends of the sliding member 34. Each positioning assembly 35 includes a rivet 351, a fixing piece, a spring 353 and a positioning ball 354. The fixing piece 352 defines a through hole 356 at an end for the rivet 351 extending there through. A cylindrical protrusion 3521 is formed on a bottom surface of the fixing piece 352, and configured for inserting into the receiving hole 3411 of the sliding member 34. The positioning ball 354 and the spring 353 are configured for receiving in the receiving hole 3411 of the sliding member 34.

The first bracket 36 includes a pivotal plate 361 and a mounting plate 362. The pivotal plate 361 perpendicularly extends from one side of the mounting plate 362. A center of the pivotal plate 361 defines a pivotal hole 363. The pivotal hole 363 is a double-D shaped hole corresponding to the first rotatable pivot shaft 311. The mounting plate 362 is configured for connecting the double hinge assembly 30 to a main body of the electronic device.

The second bracket 37 includes a sheet portion 371 defining an assembling hole 373 in a center. The assembling hole 373 is a double-D shaped hole corresponding to the second rotatable pivot shaft 321. The sheet portion 371 perpendicularly forms a pair of connecting pieces 372 at a same side. The connecting pieces 372 are configured for connecting the double hinge assembly 30 to a cover of the electronic device.

Referring to FIGS. 1 through 3 again, in assembling of the double hinge assembly 30, the sliding member 34 is slidably positioned in the sliding groove 3311 of the guide rail 33. The first rotatable pivot shaft 311 is inserted through the guide rail 33, the first cam 313, the resilient rings 35, and engages with the first bracket 36. The protrusions 3112 are bent 90 degrees away from a center of the first rotatable pivot shaft 311, thus preventing the first bracket 36 from sliding out of the first rotatable pivot shaft 311. The second rotatable pivot shaft 321 is inserted through the sliding member 34, the second cam 323, the resilient rings 325, the flat washer 327, and finally engages with the second bracket 37. The protrusions 3212 are bent 90 degrees away from a center of the second rotatable pivot shaft 321, thus preventing the second bracket 37 from sliding out of the second rotatable pivot shaft 321. The positioning assemblies 35 are positioned in the opposite ends of the sliding member 34 correspondingly. The spring 353 of each positioning assembly 35 is compressed between the fixing piece 352 and the positioning ball 354, and partially sleeved on the protrusion 3521. The positioning ball 354 partially extends out of the receiving hole 3411 due to the size of the bottom side of the receiving hole 3411 gradually reducing.

Figure 4:
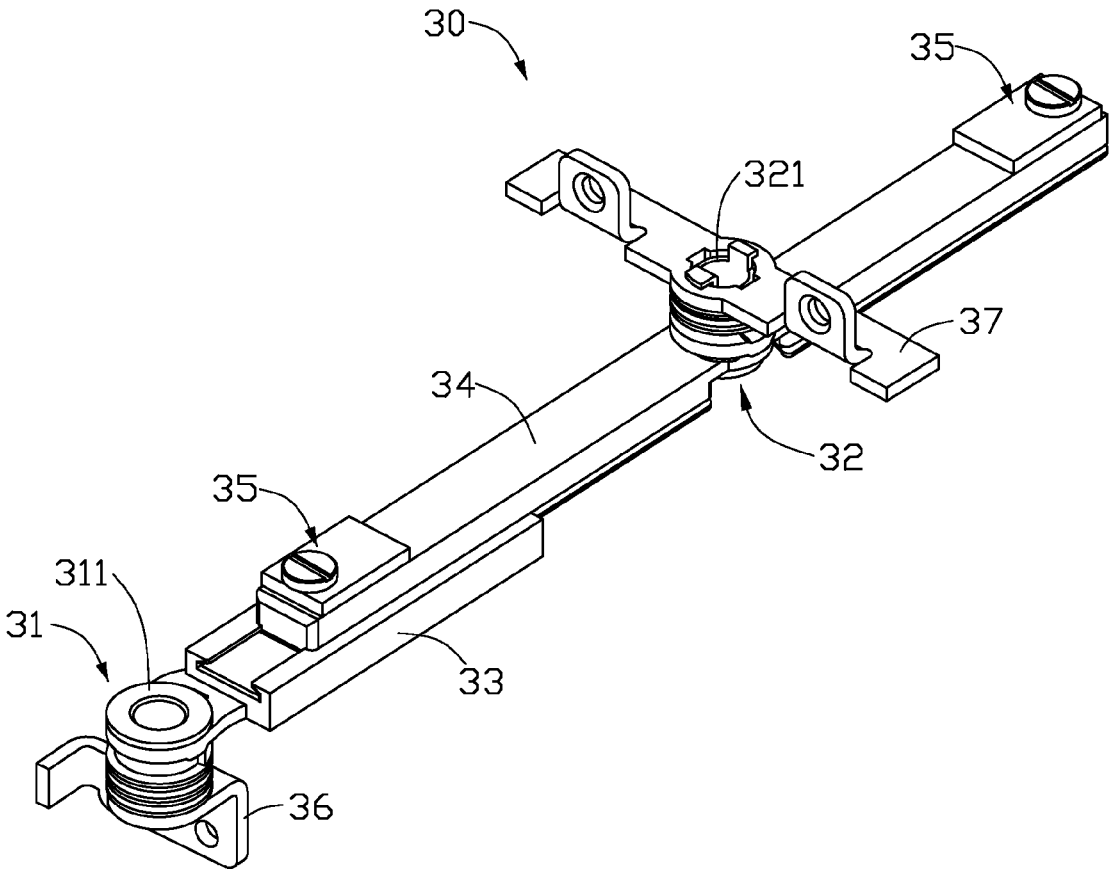
FIG. 4 is an isometric view of the double hinge assembly of FIG. 1, showing a first bracket of the double hinge assembly and a second bracket of the double hinge assembly rotated a predetermined angle relative to a guide rail and a sliding member correspondingly.
Figure 5:
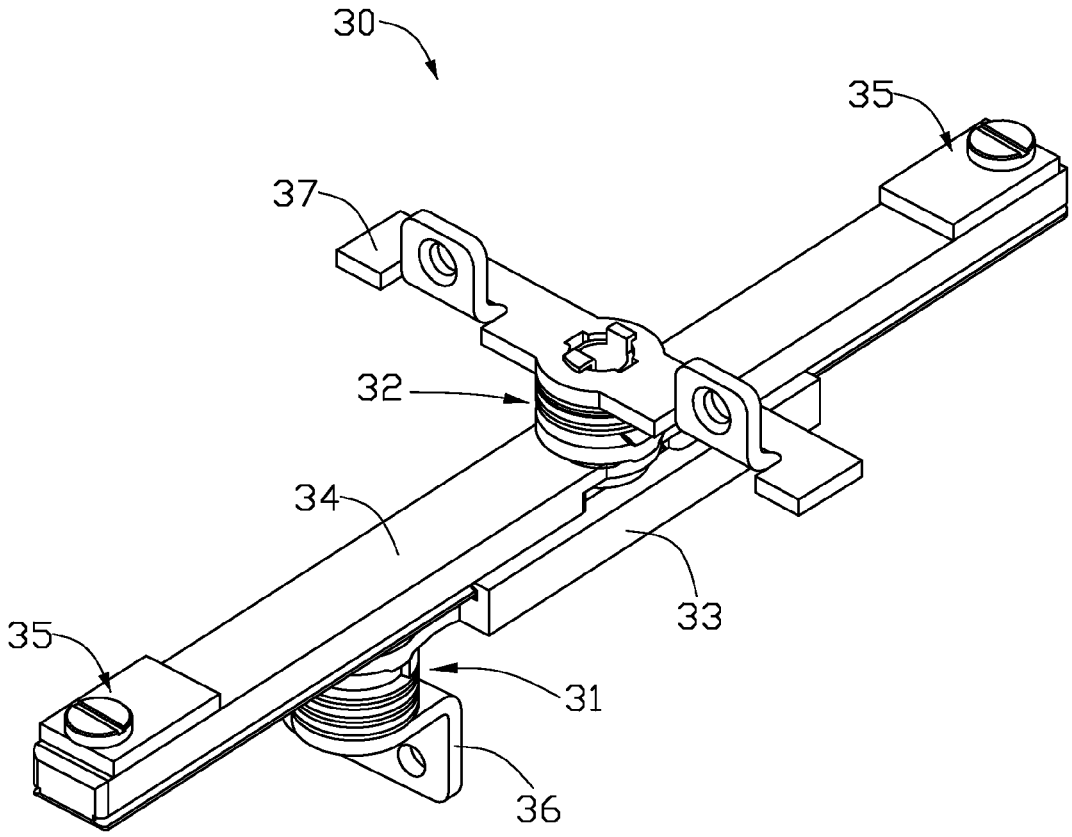
FIG. 5 is an isometric view of the double hinge assembly of FIG. 4, showing the sliding member sliding a predetermined distance relative to the guide rail.

Referring to FIGS. 4 through 5, after the double hinge assembly 30 is assembled, a rotating axis of the first rotatable pivot shaft 311 is substantially parallel to a rotating axis of the second rotatable pivot shaft 321. The first bracket 36 is rotatable together with the first rotatable pivot shaft 311 relative to the guide rail 33. The limiting protrusion 336 of the pivot socket 333 slides in the limiting guide groove 3134 of the first cam 313, in order to define a largest rotating angle between the guide rail 33 and the first bracket 36. In addition, because the two teeth 335 on the pivot socket 333 engages with the engaging surface 3132 of the first cam 313, the first rotatable pivot shaft 311 is rotated once through an angle of 90 degrees relative to the guide rail 33. The second bracket 37 can rotate on the second rotatable pivot shaft 321 relative to the sliding member 34. The limiting projection 345 of the pivot socket 342 slides in the limiting guide groove 3213 of the flange 3211, in order to define a largest rotating angle between the sliding member 34 and the second bracket 37. Furthermore, since two depressions 3422 on the pivot socket 342 engages with the engaging surface 3242 of the second cam 323, the second rotatable pivot shaft 321 is rotated once through an angle of 180 degrees relative to the sliding member 34.

The sliding member 34 could slide on the guide rail 33 to a predetermined position such that axes of one receiving hole 3411 and the blind hole 3313 are aligned in a straight line. Then, the positioning ball 354 will be partially inserted into the blind hole 3313 of the sliding member 34 due to an elastic force of the spring 353, thus positioning the sliding member 34 on the guide rail 33. When the first bracket 36 is rotated relative to the guide rail 33 about the first rotatable pivot shaft 311, the first rotatable pivot shaft 311 will rotate along with the first bracket 36. Since the first cam 313 is non-rotatable relative to the first rotatable pivot shaft 311, the first cam 313 also rotate in unison with the first rotatable pivot shaft 311. The first bracket 36 and the first rotatable pivot shaft 311 rotate until the limiting protrusion 336 reaches the ends of the limiting guide groove 3134 of the first cam 313. When the second bracket 37 rotates relative to the sliding member 34 about the second rotatable pivot shaft 321, the second rotatable pivot shaft 321 rotates in unison with the second bracket 37. Since the second cam 323 and the flat washer 327 are non-rotatable relative to the second rotatable pivot shaft 321, the second cam 323 and the flat washer 327 also rotate in unison with the second rotatable pivot shaft 321. The second bracket 37 and the second rotatable pivot shaft 321 keep being rotated until the limiting projection 345 reaches the ends of the limiting guide groove 3213 of the flange 3211.

Referring to FIGS. 6 through 9, a mobile phone 50 includes a cover 51, a main body 52, and the double hinge assembly 30 pivotally connecting the main body 52 with the cover 51. The main body 52 has a keypad 521. The cover 51 has a display 511. The first bracket 36 is fixed to the main body 52, and the second bracket 37 is fixed to the display 511. The cover 51 can be turned relative to the main body 52 via the rotation of the guide rail 33 relative to the axis of the first rotatable pivot shaft 311. The cover 51 can also be rotated relative to the main body 52 via the rotation of the sliding member 34 relative to the axis of the second rotatable pivot shaft 321. The mobile phone 50 also includes a camera (not shown) in the main body 52.

Figure 6:
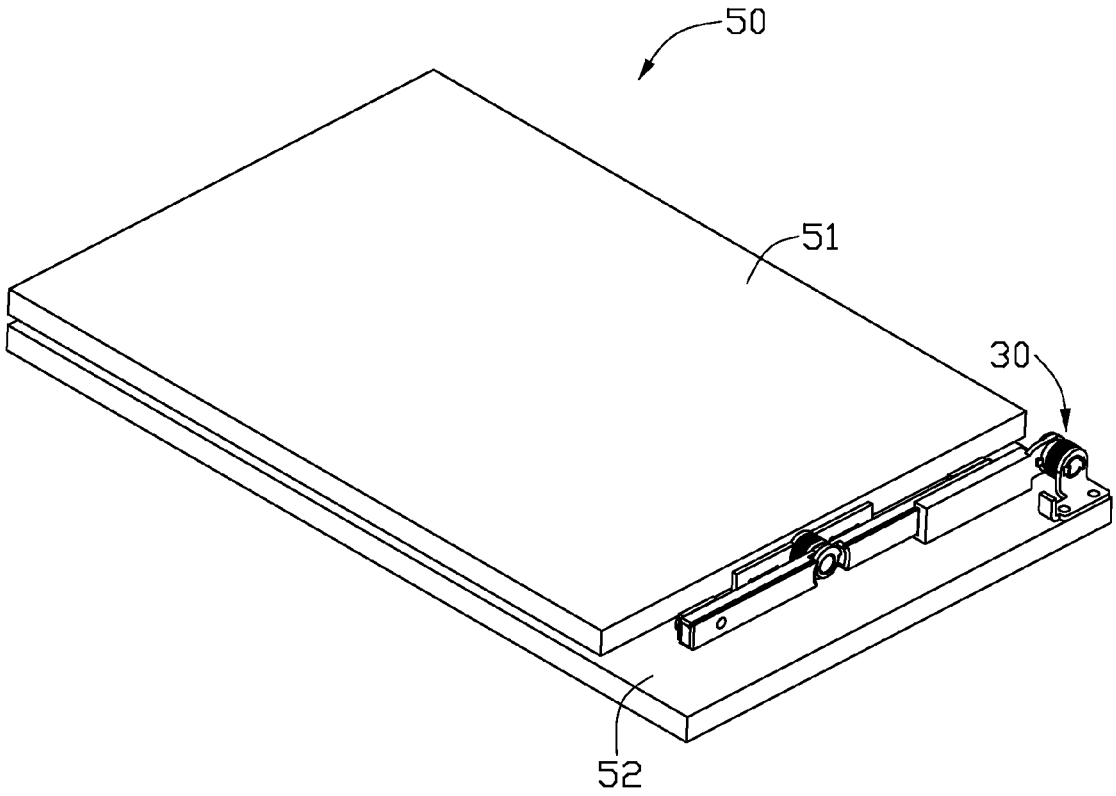
FIG. 6 is an isometric view of the mobile phone in a first closed state in accordance with a preferred embodiment of the present application.
Figure 7:
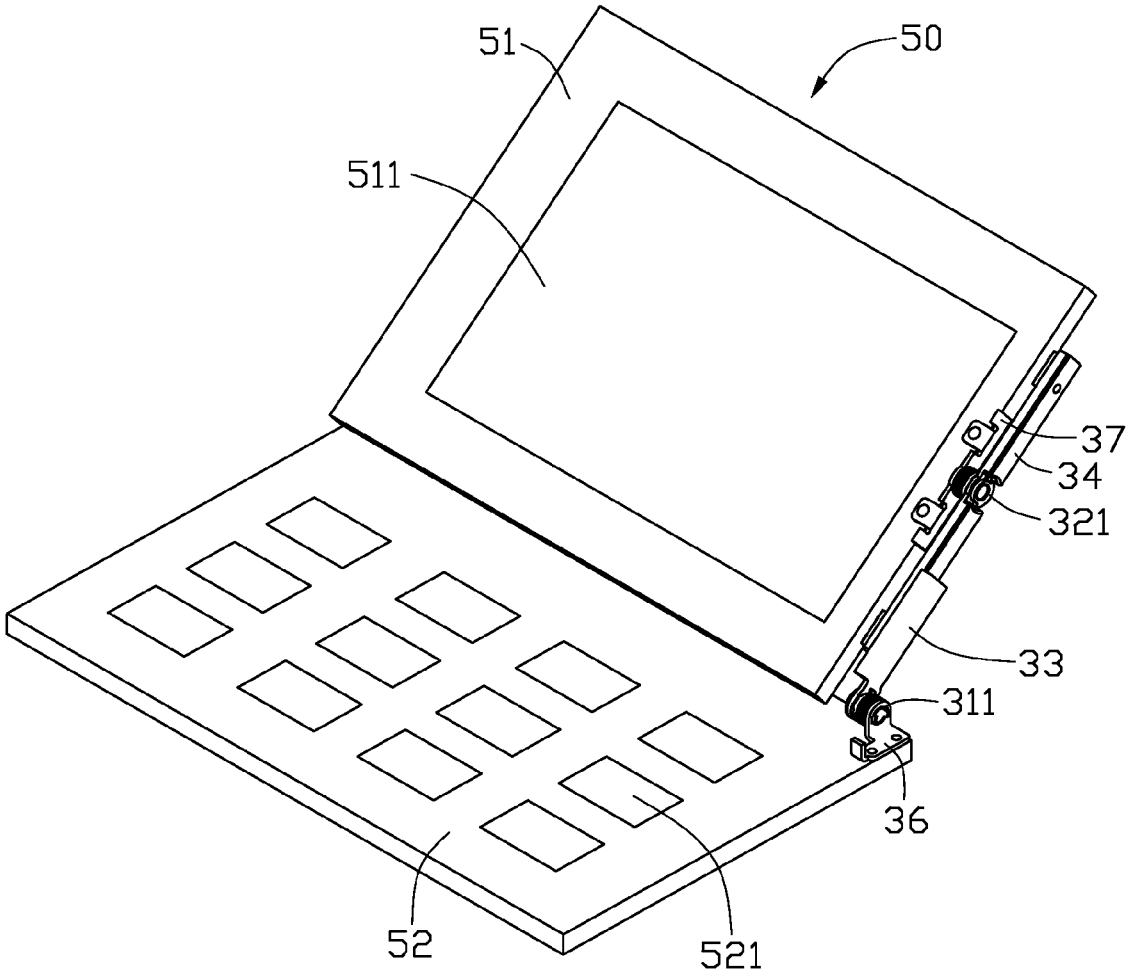
FIG. 7 is an isometric view of the mobile phone of FIG. 6, showing a cover of the mobile phone about a first rational shaft.
Figure 8:
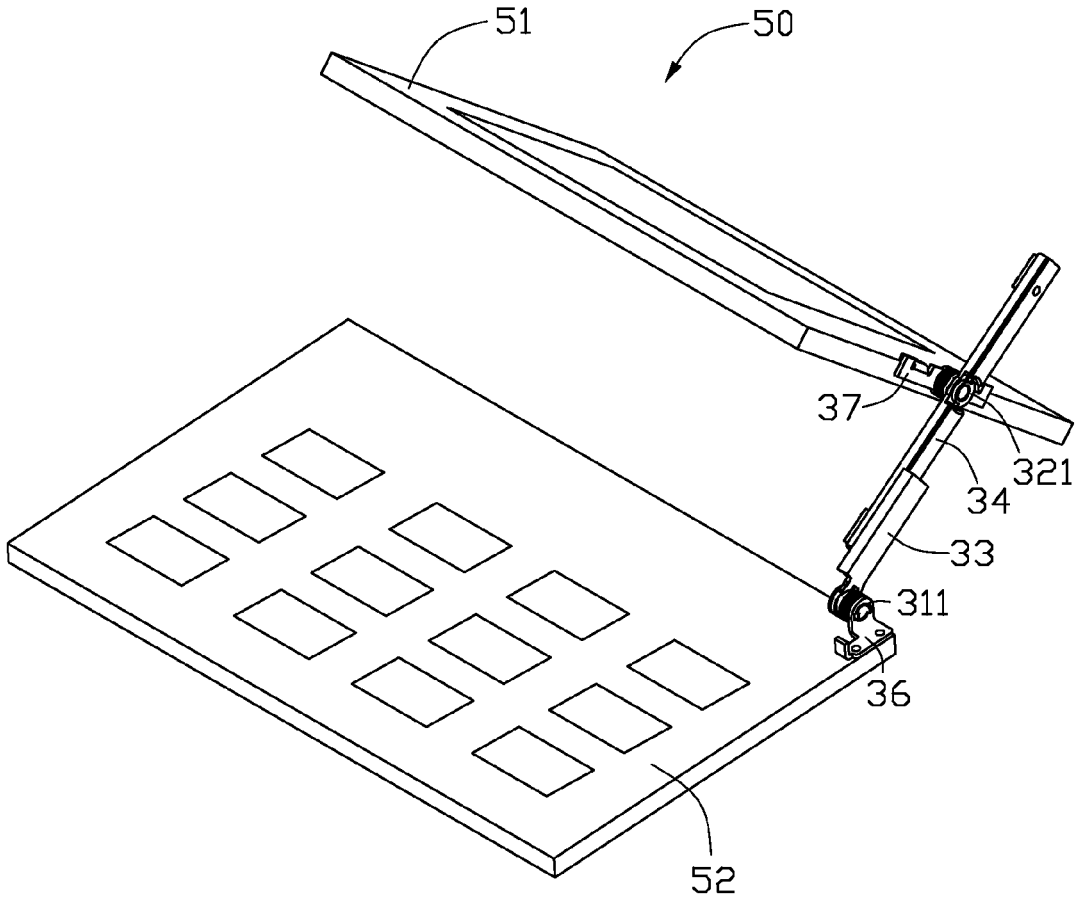
FIG. 8 is an isometric view of the mobile phone of FIG. 7, showing a cover of the mobile phone rotating an angle about a second rational shaft.
Figure 9:
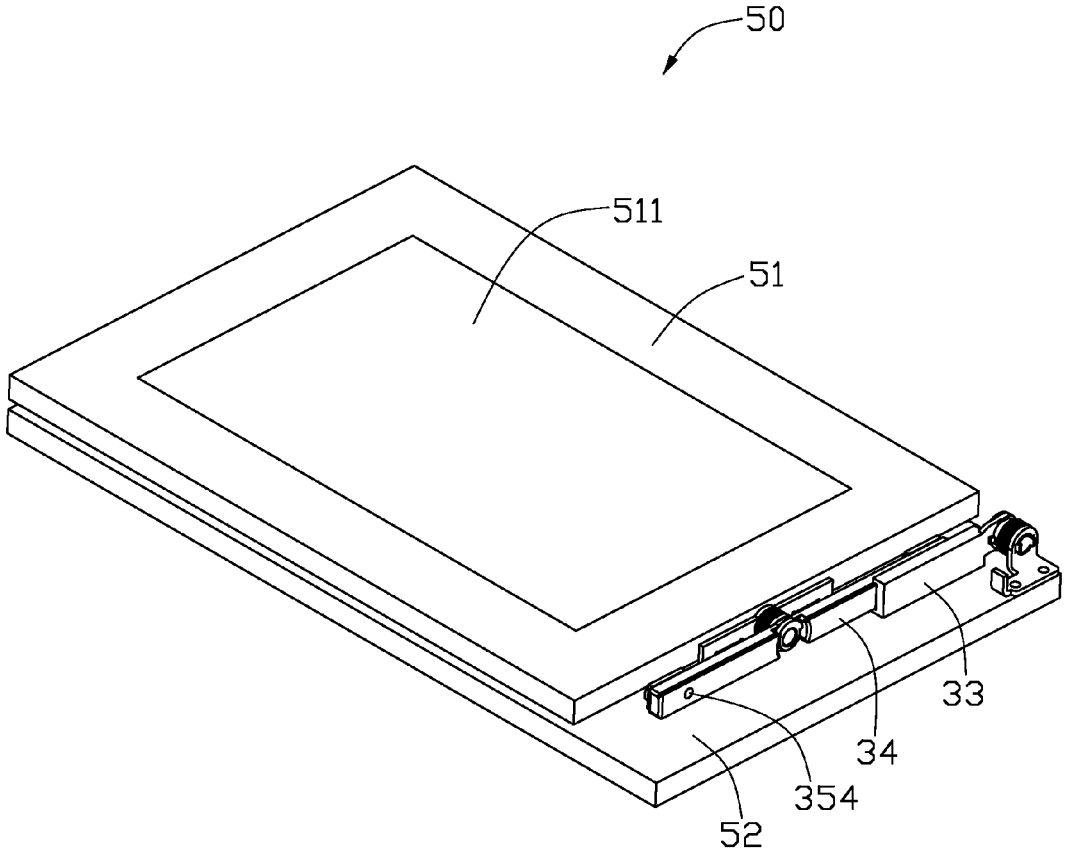
FIG. 9 is an isometric view of the mobile phone of FIG. 8, showing the mobile phone in a second close state with a display body of the cover facing to a user.
Figure 10:
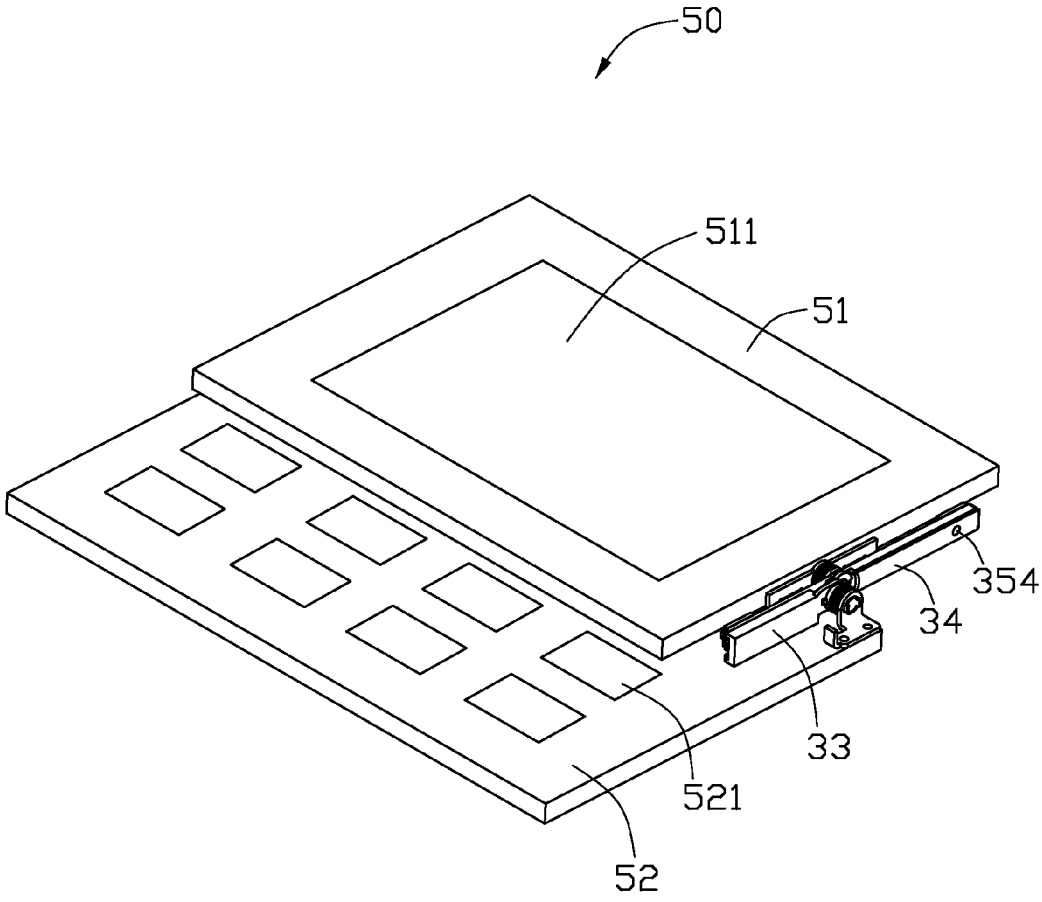
FIG. 10 is an isometric view of the mobile phone of FIG. 9, showing the cover sliding a predetermined distance relative to the main body.

When the cover 51 of the mobile phone 50 has to be rotated 180 degrees, the cover 51, along with the second hinge assembly 32, is first rotated to a predetermined angle via the first hinge assembly 31, then, the cover 51 can be further rotated to a predetermined position via the second hinge assembly 32. Thus, when the camera is configured in the main body 52 of the mobile phone 50, and a display body 511 is configured in the cover 51, the cover 51 can be rotated 180 degrees to preview self-portrait and other photos. The cover 51 can fold over the main body 52 such that the display 511 faces outwards (as shown in FIG. 9). In addition, the mobile phone 50 has a turning mode and a sliding mode. Referring to FIGS. 6 and 7, the cover 51 of the mobile phone 50 can be turned over via the rotation of the guide rail 33 relative to the axis of the first rotatable pivot shaft 311. Referring to FIGS. 9 and 10, the cover 51 of the mobile phone 50 can slide on the main body 52 via the movement of the sliding member 34 along the guide rail 33. An operation for changing the turning mode to the sliding mode of the mobile phone 50 is as follows: the cover 51 is turned over relative to the first rotatable pivot shaft 311, and rotated 180 degrees relative to the second pivot shaft 321 and subsequently the cover 51 is folded over the main body 52.

It should be pointed out that, the cross-sections of the first rotatable pivot shaft 311 and the second rotatable pivot shaft 321 can be other shape, such as hexagon shaped. Accordingly, a corresponding cam also defines a hexagonal hole therein. Furthermore, the first bracket 36 can be rotatably connected to the first rotatable pivot shaft 311, when the first rotatable pivot shaft 311 is fixed to the guide rail 33. Correspondingly, the second bracket 37 can rotatably connects to the second rotatable pivot shaft 321, when the second rotatable pivot shaft 321 is fixed to the sliding member 34. Still further, both the first bracket 36 and the first rotatable pivot shaft 311 can be rotatably connected to the guide rail 33, correspondingly, both the second bracket 37 and the second rotatable pivot shaft 321 can be rotatably connected to the sliding member 34. In addition, the fixing piece 352 can be fixed to the sliding member 34 by jointing.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A double hinge assembly for connecting a first member and a second member, comprising:

a first hinge assembly having a first noncircular rotatable pivot shaft;

a second hinge assembly having a second noncircular rotatable pivot shaft;

a first bracket having a noncircular hole and a second bracket having a noncircular hole; and a guide rail and a sliding member slidable on the guide rail;

wherein the guide rail defines a first pivot hole, the sliding member defines a second pivot hole, the first rotatable pivot shaft extends through the first pivot hole of the guide rail and is nonrotatably extended through said noncircular hole in said first bracket, the second rotatable pivot shaft extends through the second pivot hole of the sliding member and is nonrotatably extended through said noncircular hole in said second bracket, and a rotating axis of the first noncircular pivot shaft is substantially parallel to a rotating axis of the second noncircular rotatable pivot shaft;

wherein said guide rail, said sliding member and said second bracket are rotatable with respect to said first bracket, said sliding member and said second bracket are slidable with respect to said guide rail and said first bracket for positioning of the first member with respect to the second member;

wherein the double hinge assembly further comprises two positioning assemblies, the two positioning assemblies are positioned in opposite ends of the sliding member correspondingly, thus defining a largest sliding length of the sliding member on the guide rail;

wherein each positioning assembly comprises a fixing piece, a spring and a positioning ball; the sliding member defines two receiving holes on opposite ends of the sliding member; the spring and the positioning ball are received in the receiving hole of the sliding member, the fixing piece is fixed to one end of the sliding member, such as to make the positioning ball partially extending out of the receiving hole, the guide rail defines a blind hole to partially receive the positioning ball.

2. The double hinge assembly as claimed in claim 1, wherein the first hinge assembly further comprises a first cam sleeved on the first rotatable pivot shaft, and the first cam has an engaging surface engaging with the guide rail.

3. The double hinge assembly as claimed in claim 2, wherein the first cam defines a limiting guide groove in a cylindrical surface, the guide rail forms a limiting protrusion adjacent to the first pivot hole, and the limiting protrusion is configured to be slidable in the limiting guide groove of the limiting ring, thus defining a range of first angular rotation between the first rotatable pivot shaft and the guide rail.

4. The double hinge assembly as claimed in claim 1, wherein the second rotatable pivot shaft comprises a flange formed around one end thereof, the flange defines a limiting guide groove in a cylindrical surface, the sliding member forms a limiting protrusion adjacent to the second pivot hole, and the limiting protrusion is configured to be slidable in the limiting guide groove of the flange, thus defining a range of second angular rotation between the second rotatable pivot shaft and the sliding member.

5. The double hinge assembly as claimed in claim 4, wherein the flange defines a limiting guide groove in the cylindrical surface, the sliding member forms a limiting protrusion adjacent to the first pivot hole, and the limiting protrusion is configured to be slidable in the limiting guide groove of the flange, thus defining a range of second angular rotation between the second rotatable pivot shaft and the sliding member.

6. The double hinge assembly as claimed in claim 5, wherein the second hinge assembly further comprises a second cam sleeved on the second rotatable pivot shaft, and the second cam has an engaging surface engaging with the connecting member.

7. The double hinge assembly as claimed in claim 1, wherein at least one of the first rotatable pivot shaft and the second rotatable pivot shaft is a hollow shaft.

8. The double hinge assembly as claimed in claim 1, wherein a protrusion is formed on the fixing piece, the protrusion extends into the receiving hole of the sliding member, and the spring is partially sleeved on the protrusion.

9. The double hinge assembly as claimed in claim 1, wherein the guide rail comprises a guiding portion, the guiding portion defines a sliding groove, the sliding member is slidably received in the sliding groove of the guiding portion.

10. The double hinge assembly as claimed in claim 9, wherein the guide rail further comprises a pivot socket connected to one end of the guiding portion, the pivot socket defines a pivot hole, the first rotatable pivot shaft extends through the pivot hole of the pivot socket.

11. An electronic device comprising:

a main body;

a cover having a display body; and a double hinge assembly connecting the main body and the cover such that the cover is rotatable around two horizontal axes relative to the main body, the hinge assembly comprising:

a first hinge assembly having a first noncircular rotatable pivot shaft;

a second hinge assembly having a second noncircular rotatable pivot shaft;

a first bracket having a noncircular hole and a second bracket having a noncircular hole; and a guide rail and a sliding member slidable on the guide rail;

wherein the guide rail defines a first pivot hole, the sliding member defines a second pivot hole, the first rotatable pivot shaft extends through the first pivot hole of the guide rail and is nonrotatably extended through said noncircular hole in said first bracket, the second rotatable pivot shaft extends through the second pivot hole of the sliding member and is nonrotatably extended through said noncircular hole in said second bracket, and a rotating axis of the first noncircular pivot shaft is substantially parallel to a rotating axis of the second noncircular rotatable pivot shaft;

wherein said guide rail, said sliding member and said second bracket are rotatable with respect to said first bracket, said sliding member and said second bracket are slidable with respect to said guide rail and said first bracket for positioning of the first member with respect to the second member;

wherein the double hinge assembly further comprises two positioning assemblies, the two positioning assemblies are positioned in opposite ends of the sliding member correspondingly, thus defining a largest sliding length of the sliding member on the guide rail;

wherein each positioning assembly comprises a fixing piece, a spring and a positioning ball; the sliding member defines two receiving holes on opposite ends of the sliding member; the spring and the positioning ball are received in the receiving hole of the sliding member, the fixing piece is fixed to one end of the sliding member, such as to make the positioning ball partially extending out of the receiving hole, the guide rail defines a blind hole to partially receive the positioning ball.

* * * * *